US006055294A

United States Patent [19]

Foerst et al.

[11] Patent Number: 6,055,294

[45] Date of Patent: Apr. 25, 2000

[54] X-RAY TUBE WITH MAGNETIC DEFLECTION OF THE ELECTRON BEAM

[75] Inventors: Bernhard Foerst, Ebermannstadt; Marion Meusel; Roland Schmidt, both of Erlangen, all of Germany

[73] Assignee: Siemens Aktiengesellschaft, Munich, Germany

[21] Appl. No.: 09/115,598

[22] Filed: Jul. 15, 1998

[30] Foreign Application Priority Data

Jul. 24, 1997 [DE] Germany ..... 197 31 985

[51] Int. Cl.[7] ..... H01J 35/30

[52] U.S. Cl. ..... 378/138; 378/137

[58] Field of Search ..... 378/137, 138, 378/119, 121, 113

[56] References Cited

U.S. PATENT DOCUMENTS 5,703,926 12/1997 Bischof ..... 378/125
5,812,632 9/1998 Schardt et al. ..... 378/137
5,822,395 10/1998 Schardt et al. ..... 378/137
5,898,755 4/1999 Meusel et al. ..... 378/138
5,909,479 6/1999 Rother ..... 378/119

FOREIGN PATENT DOCUMENTS 0 460 421 12/1991 European Pat. Off. .
41 25 926 8/1992 Germany .

*Primary Examiner*—David P. Porta
*Assistant Examiner*—Drew A. Dunn
*Attorney, Agent, or Firm*—Hill & Simpson

[57] ABSTRACT

An X-ray tube has a cathode and an anode that are arranged in a vacuum housing. For deflection of the electron beam propagating from the cathode to the anode, two electromagnets are provided, of which each having a U-shaped yoke with two arms connected with one another by a base segment, and comprises a winding surrounding the base segment. The respective end faces of the arms of the two yokes are arranged opposite one another so as to maintain an air gap. The magnetic poles positioned opposite one another have the same polarity. The electron beam proceeds through the opening limited by the two yokes.

8 Claims, 2 Drawing Sheets

X-RAY TUBE WITH MAGNETIC DEFLECTION OF THE ELECTRON BEAM

BACKGROUND OF THE INVENTION

1. Field of the Invention

The present invention relates to an X-ray tube of the type having a cathode and an anode that are arranged in a vacuum housing, and an arrangement for magnetically deflecting the electron beam.

2. Description of the Prior Art

The possibility of deflecting the electron beam, and thus the focal spot, in an X-ray tube is of particular significance in connection with computed tomography, since an improvement of the image quality can be achieved by means of the known measure of positioning the focal spot between two end positions, thereby achieving a multiplication of the data provided for the calculation of the image of a body slice.

From German PS 41 25 926 and European Application 0 460 421, X-ray tubes of the type described above are known. In order to avoid distortions of the focus geometry that are caused by the deflection of the electron beam, which can have a disadvantageous effect on the imaging quality, the electron beam produced for the deflection in the vicinity of the magnetic field may not comprise any significant gradients in the plane that proceeds perpendicularly to the direction of propagation of the electron beam.

This requirement cannot be met by the X-ray tube specified in European Application 0 460 421, in which the arrangement for deflecting the electron beam is formed by a deflecting unit that surrounds the shaft-type housing part. Rather, the deflecting unit effects not only a deflection but also a defocusing of the electron beam. The focal spot, which arises at the impact point of the electron beam on the target of the anode, thus experiences, due to the effect of the deflecting unit, not only a displacement on the target, but also an undesirable change in size and/or shape.

In the X-ray tube specified in German PS 41 25 926, the arrangement for deflecting the electron beam is formed by an air-core coil located outside the vacuum housing. In order to enable the aforementioned condition to be fulfilled, this air-core coil must, disadvantageously, have a very voluminous construction. Moreover, in order to bring about a particular deflection of the electron beam, considerable electrical power must be supplied to the air-core coil, so that an undesirable degree of lost heat is released in connection with the deflection of the electron beam, which represents a further disadvantage in view of the heat problems which already exist in the operation of X-ray tubes.

SUMMARY OF THE INVENTION

An object of the present invention is to provide an X-ray tube of the type described above wherein the heat loss which occurs in the deflection of the electron beam is reduced, and, without the occurrence of significant defocusing phenomena, the arrangement for deflecting the electron beam can occupy a smaller space.

According to the invention, this object is achieved in an X-ray tube having a cathode and an anode that are arranged in a vacuum housing, and having two electromagnets for the deflection of the electron beam propagating from the cathode to the anode. Each of these electromagnets has a yoke, a preferably a U-shaped yoke, with two arms connected to each other by a base segment and a winding that surrounds the base segment. The respective end surfaces of the arms of the two yokes are arranged opposite one another so as to maintain an air gap, with the magnetic poles which are positioned opposite one another having the same polarity, and wherein the electron beam proceeds through the opening bounded by the two yokes.

In the inventive X-ray tube, the arrangement for the magnetic deflection of the electron beam is thus formed by two electromagnets that are arranged so that the pole faces of magnetic poles of the same polarity lie opposite one another. Since the pole faces lie opposite one another so as to form an air gap, a magnetic field is formed that is largely homogenous within the opening bounded by the yokes of the electromagnet, and has its highest field strength here. Since the electron beam propagates between the pole faces, the largest magnetic flux of the magnetic field of the electromagnet is used for the deflection of the electron beam. The electrical power required to bring about a particular deflection of the electron beam thus is small. This has the consequence that only small heat losses occur in connection with the deflection of the electron beam. The danger that defocusing phenomena will occur when the electron beam passes through the magnetic field is small, because, as mentioned, the magnetic field is approximately homogenous in the region between the pole faces, and in addition the geometrical structure of the remaining region of the magnetic field through which the electron beam passes is such that defocusing phenomena exhibited by the electron beam on its path through the part of the magnetic field located on the one side of the electromagnets are at least partially canceled when the electron beam runs through the part of the magnetic field located on the other side of the electromagnet. In addition, it is advantageous that the deflection of the electron beam can be easily influenced very precisely due to the homogeneity of the magnetic field which is present in the opening bounded by the yokes, by modifying the current strength of the current flowing through the winding of the electromagnet.

When the segments of the arms located in the region of the electron beam are disposed substantially parallel to one another, the preconditions are good that the defocusing phenomena appearing on the path of the electron beam due to the part of the magnetic field located on the one side of the electromagnets can be eliminated on the path of the electron beam by means of the part of the magnetic field located on the other side of the electromagnets. A further improvement is achieved when the arms whose end faces lie opposite one another have respective central axes that are substantially co-linear. The elimination of the defocusing phenomena then takes place to a particularly high degree when these axes of the segments of the arms located in the region of the electron beam lie in a common plane, to which the main direction of propagation of the electron beam proceeds at substantially a right angle.

Possible remaining defocusing phenomena can be minimized by arranging the electromagnets so that the main direction of propagation of the electron beam intersects a straight line substantially in the center of the focusing arrangement, this line in turn intersecting the central axes of the limb segments located in the region of the electron beam at substantially a right angle, at least at the substantially central point between the respectively opposed end surfaces. With respect to the symmetry of the magnetic field to the plane containing the axes of the yoke arm segments located in the region of the electron beam, the electron beam then exhibits a curve that ensures particularly thoroughly that the defocusing phenomena occurring on the path of the electron beam due to the part of the magnetic field located on the one side of the aforementioned plane are eliminated on the path of the electron beam by means of the part of the magnetic field located on the other side of that plane.

The "main direction of propagation of the electron beam," as used herein means the direction that the electron beam has at the two pole shoes, or the pole faces thereof, when the electron beam assumes the center position between the two end positions that can be reached by the deflection of the electron beam.

A further advantage of the invention is that the arms of the yokes are located close to the electron beam to be deflected, with the consequence that the power that has to be supplied to the windings in order to effect a particular deflection of the electron beam is small, and the electromagnets are small and inexpensive. Particularly favorable relationships result when the cross-section of the shaft-type housing part according to an embodiment of the invention does not significantly exceed the size required for an unhindered passage of the electron beam through the arrangement.

DESCRIPTION OF THE PREFERRED EMBODIMENTS

Figure 1:
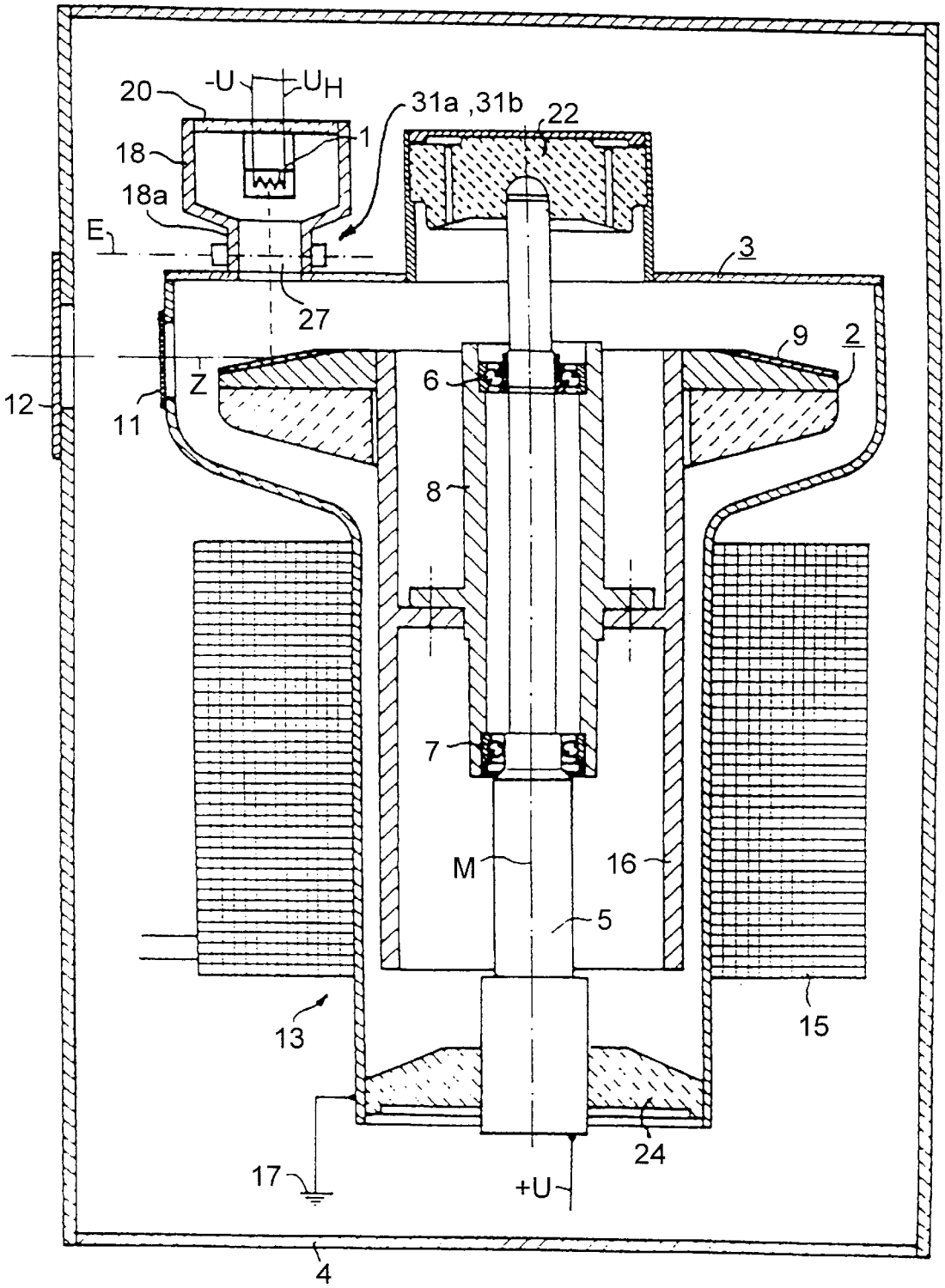
FIG. 1 shows an inventive X-ray tube in a schematic representation, in longitudinal section.

The X-ray tube according to FIG. 1 has a stationary cathode 1 and a rotating anode 2, which are arranged in a vacuum-sealed, evacuated vacuum housing 3, which in turn is contained in a protective housing 4 filled with an electrically insulating liquid cooling medium, e.g. insulating oil. The rotating anode 2 is rotatably mounted on a stationary axle 5 in the vacuum housing 3 by means of two roller bearings 6, 7 and sleeve 8.

The rotating anode 2, constructed so as to be rotationally symmetrical to the center axis M of the axle 5, has a target (anode dish) 9, provided for example with a layer of a tungsten-rhenium alloy, on which an electron beam 10 emanating from the cathode 1 strikes for the production of X-rays. (In FIGS. 1 and 3, only the center axis of the electron beam 10 is shown, as a broken line.) The corresponding radiation beam bundle, of which only the central beam Z is shown in FIG. 1, is emitted through radiation exit windows 11 and 12, provided in the vacuum housing 3 and the protective housing 4, and arranged so as to be aligned with one another.

For driving the rotating anode 2, an electromotor constructed as a squirrel-cage motor is provided, designated as a whole with 13, and having a stator 15 placed on the vacuum housing 3 and a rotor 16 that is located inside the vacuum housing 3 and is connected in rotationally fixed fashion with the rotating anode 2.

A funnel-shaped housing segment 18 is disposed on the vacuum housing 3, this housing segment 18 being at ground potential 17 and being constructed from a metallic material, except for an insulator 20 that bears the cathode 1 and two insulators 22 and 24 that receive the axis 5. The housing segment 18 is connected with the remaining vacuum housing 3 via a shaft-type housing part 18*a*. The cathode 1 is attached to the funnel-shaped housing segment 18 by means of the insulator 20. The cathode 1 is thus located, so to speak, in a separate chamber of the vacuum housing 3 that is connected with this housing segment 18 via the shaft-type housing part 18*a*.

The positive high voltage +U for the rotating anode 2 is at to the axle 5, which is housed in vacuum-tight fashion in the insulator 22. The tube current thus flows via the roller bearings 6 and 7.

As can be seen from the schematic drawing in FIG. 1, the negative high voltage −U is at one terminal of the cathode 1. The heating voltage $U_H$ lies between the two terminals of the cathode 1. The lines leading to the cathode 1, the axis 5, the vacuum housing 3 and the stator 15 are connected to a known power supply (not shown) located outside the protective housing 4, which provides the voltages necessary for the operation of the vacuum tube. From the above, it is clear that the X-ray tube according to FIG. 1 is of two-pole construction.

From FIG. 1, it can be seen that the electron beam 10 emanating from the cathode 1 propagates through the shaft-type housing part 18*a* on its path to the rotating anode 2. The shaft-type housing part 18*a* thus bounds an aperture 27. The dimensions thereof are chosen such that it does not substantially exceed the dimensions required for an unhindered passage of the electron beam 10 therethrough.

The funnel-shaped housing segment 18 and the upper wall of the vacuum housing 3 shown in FIG. 1 (at least these parts, but preferably all metallic parts of the vacuum housing 3, are made of non-metallic materials, e.g. special steel) thus bound an annular space that is located outside the vacuum housing 3 and is radially upwardly open. Two electromagnets 31*a* and 31*b* are arranged in this annular space, which are indicated schematically in FIG. 1 and are identical in the specified exemplary embodiment. The electromagnets 31*a* and 31*b* produce a magnetic deflecting field for the electron beam 10, which deflects the electron beam 10 perpendicular to the drawing plane of FIG. 1.

Figure 2:
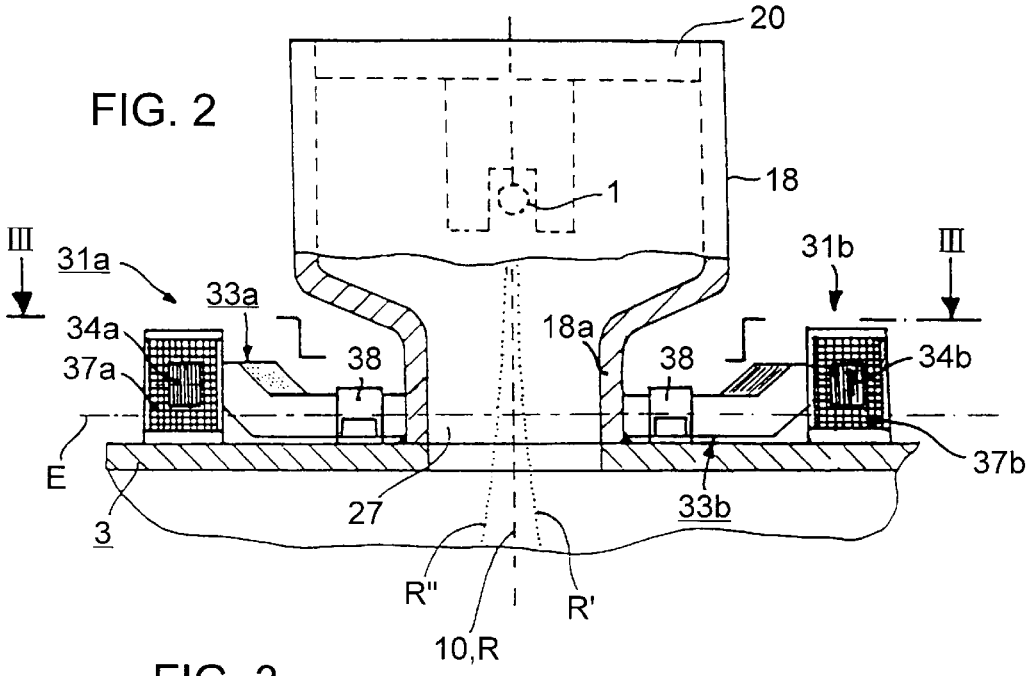
FIG. 2 shows a partial view of a section according to the line II—II in FIG. 3.
Figure 3:
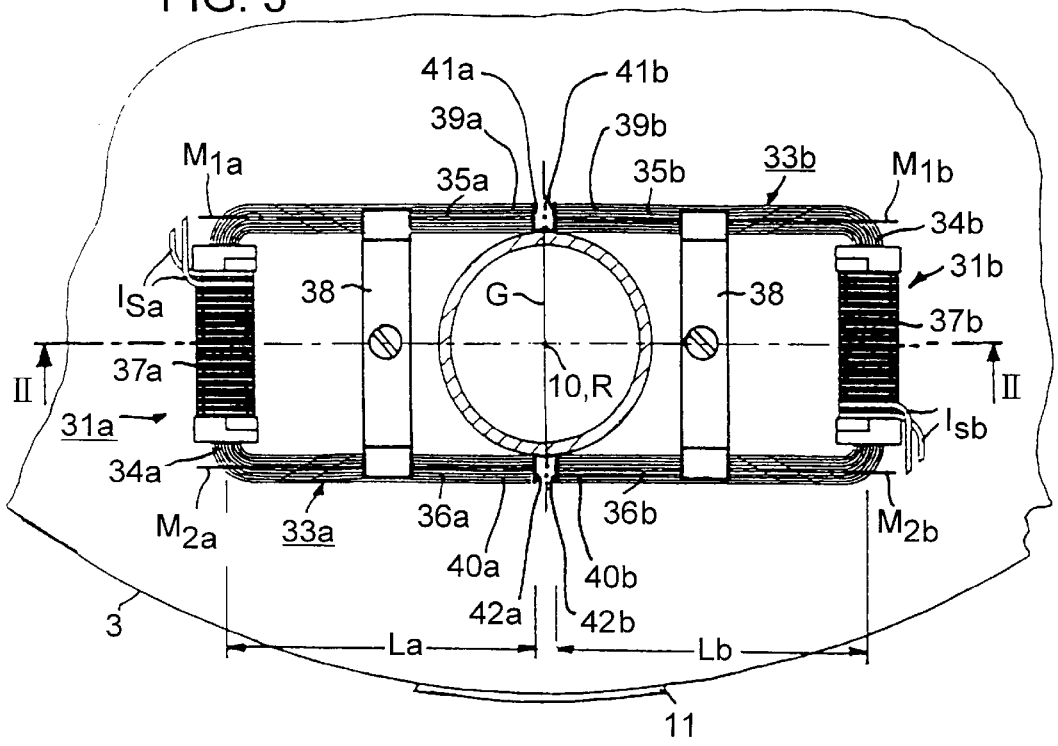
FIG. 3 shows a partial view of a section according to the line III—III in FIG. 2.

As shown in FIGS. 2 and 3, each of the electromagnets 31*a* and 31*b* has a U-shaped yoke 33*a* or 33*b*, with arms 35*a*, 36*a* or 35*b*, 36*b* that are connected to one another by a base segment 34*a* or 34*b*, and a winding 37*a* or 37*b* that surrounds the base segment 34*a* or 34*b*. The ends of the limbs 35*a*, 36*a* or 35*b*, 36*b* form pole shoes 39*a*, 40*a* or 39*b*, 40*b*, whose respective pole faces 41*a*, 42*a* or 41*b*, 42*b* are disposed flat and parallel to one another.

The electromagnets 31*a* and 31*b* are arranged with the pole faces 41*a*, 42*a* and 41*b*, 42*b* facing one another in such a way that the shaft-type housing part 18*a* is located between the arms 35*a*, 36*a*, 35*b* and 36*b*. The arms 35*a*, 36*a*, 35*b* and 36*b* are arranged so that they are located close to the shaft-type housing part 18*a*, or, as shown in FIGS. 1 and 2, are adjacent to it.

The windings 37*a* and 37*b* of the electromagnets 31*a* and 31*b* are connected to a power source (not shown) with their terminals designated $I_{Sa}$ and $I_{sb}$, this source causing a current to flow through the windings 37*a* and 37*b* during the operation of the X-ray tube. The winding direction and the polarities of the windings are thereby chosen so that the magnetic poles that form in the region of the oppositely facing pole faces 41*a*, 42*a* and 41*b*, 42*b* have the same polarity.

When the current flowing through the windings 37*a*, 37*b* is a direct current, the electron beam flowing through the opening bounded by the two yokes 33*a* and 33*b* is statically deflected, so that the static position of the focal spot can be adjusted. In this way, it is possible, for example given the use of the X-ray tube in a computed tomography apparatus, to adjust the position of the focal spot relative to the center of rotation of the gantry of the computed tomography apparatus, and relative to the beam detector attached to the gantry, opposite the X-ray tube.

If a periodic deflection of the electron beam 10 is desired, the current supplied by the deflection circuit has a curve that is for example sawtooth-shaped, sinusoidal, or triangular.

The yokes 33*a* and 33*b*, constructed in a known way from thin sheet lamellae, are shaped and arranged in such a way that the arms 35*a* and 35*b*, as well as the arms 36*a* and 36*b*, have co-linear central axes $M_{1a}$ and $M_{1b}$ or $M_{2a}$ to $M_{2b}$, which substantially in a common plane E (FIG. 1). The arms 35*a*, 36*a* and 35*b*, 36*b* are bent at a right angle in the region of their ends connected with the base segments 34*a* or 34*b*, in order to create space for the windings 37*a* or 37*b*. The limbs 35*a*, 36*a*, and 35*b*, 36*b*, which are linear in the specified exemplary embodiment, have respective lengths $L_a$, $L_b$ that are dimensioned such that the main direction of propagation R (shown as a broken line) of the electron beam 10 intersects substantially in the center the straight line that intersects the central axes $M_{1a}$ and $M_{1b}$, and the central axes $M_{2a}$ and $M_{2b}$ in the center of the air gap.

Of course, in order to avoid adverse effects on the magnetization characteristics, the sheet lamellae must be made red hot after their processing (cutting and bending), in order to cancel structural changes caused by the processing.

The electromagnets 31*a* and 31*b* are attached to the vacuum housing 3 in such a way that the main direction of propagation R of the electron beam 10 proceeds at least essentially at a right angle to the plane E, as can be seen from FIG. 1 in connection with FIGS. 2 and 3, whereby in FIG. 3 the curve of the electron beam 10 is also shown as a dotted line for the two end (extreme) positions that can be reached by means of the deflection of the electron beam 10, these extreme oath positions being designated R' and R".

As a result of the specified construction of the electromagnets 31*a* and 31*b*, the resulting magnetic field of the electromagnets 31*a* and 31*b* that is formed is symmetrical to the plane E, and is substantially homogenous in the plane E, which is disposed at substantially a right angle to the main direction of propagation R of the electron beam 10. This, and the specified arrangement of the electromagnets 31*a* and 31*b* relative to the vacuum housing 3, has the consequence that defocusing phenomena that occur when the electron beam 10 passes through the part of the magnetic field located on the one side of the plane E on its path through the shaft-type housing part 18*a* are cancelled practically completely when the electron beam 10 passes through the part of the magnetic field on the other side of the plane E.

By means of the specified arrangement of the electromagnets 31*a* and 31*b*, it is further achieved that the arms 35*a*, 36*a* and 35*b*, 36*b* can be located very close to the electron beam 10, and thus only a low power is required for the deflection of the electron beam 10. Moreover, the heat produced by operation of the electromagnets 31*a* and 31*b* can unproblematically be transferred to the cooling medium located in the protective housing, to be removed with heat generated by other components during operation of the X-ray tube.

In addition, the electromagnets 31*a* and 31*b* are very compact, and can be fixed very easily to the vacuum housing 3, e.g. by means of two clamping parts 38 screwed to the vacuum housing 3.

Of course, in the dimensioning of the shaft-type housing part 18*a*, and thus of the aperture 27, the magnitude of the deflection of the electron beam 10 by means of the electromagnets 31*a* and 31*b* is taken into account.

In the specified exemplary embodiment, the electromagnet 31*a* and 31*b* are located entirely outside the vacuum housing 3. However, it is also possible to arrange one or both electromagnets 31*a* or 31*b* entirely or partially inside the vacuum housing 3.

Since the vacuum housing 3 is at ground potential, and is thereby at a more positive potential than the cathode 1, a larger portion of the electrons back-scattered by the rotating anode 2 is captured by the regions of the vacuum housing 3 that limit and are adjacent to the aperture 27. Apart from its actual object, the vacuum housing 3 thus fulfills the function of a diaphragm serving for the reduction of the extrafocal radiation, in particular in the region of the housing part 18*a*.

Since the housing part 18*a*, which limits or comprises the aperture 27, is directly in contact with cooling medium located in the protective housing 4, except, possibly, for a small region in which the arms 35*a*, 36*a* and 35*b*, 36*b* can be adjacent to the outer side of the housing part 18*a*, a good cooling is ensured, so that thermal problems cannot occur.

The X-ray tube shown in FIG. 1 is what is known as a two-pole X-ray tube, however, the inventive X-ray tube can also be constructed as a single-pole X-ray tube. The vacuum housing 3 and the rotating anode 2 are at the same potential, namely ground potential 17, while the negative high voltage −U is at to the cathode 1. In order to cause both the rotating anode 2 and the vacuum housing 3 to be at ground potential 17, it is for example possible to provide, instead of the insulator 22 and/or the insulator 24, an end shield formed from an electrically conductive material, so that there is an electrically conductive connection between the rotating anode 2 and the vacuum housing 3. Alternatively, or in addition, the axle 5 can be at ground potential 17.

Although the invention has been explained exclusively on the basis of an X-ray tube with a rotating anode mounted in roller bearings, it can also be used in X-ray tubes with a rotating anode mounted in plain bearings, known as rotating tubes (the vacuum housing rotates together with the anode), and in X-ray tubes with a fixed anode.

Although modifications and changes may be suggested by those skilled in the art, it is the intention of the inventor to embody within the patent warranted hereon all changes and modifications as reasonably and properly come within the scope of his contribution to the art.

We claim as our invention:

1. An X-ray tube comprising:

a vacuum housing;

an anode and a cathode contained in said vacuum housing, said cathode emitting an electron beam which propagates along an electron beam path to said anode;

a deflection arrangement disposed to interact with and deflect said electron beam in said electron beam path, said deflection arrangement comprising two electromagnets;

each of said two electromagnets comprising a U-shaped yoke having two arms connected by a base segment, and a winding on said base segment which, when supplied with current, gives the electromagnet on which the winding is wound a magnetic polarization;

said two arms of each yoke having respective end faces of opposite magnetic polarities so that each of said two electromagnets has an end face pair, the respective end face pairs of the two electromagnets being disposed facing and spaced from each other forming a gap, said yokes of said two electromagnets bounding an opening through which said electron beam proceeds along said electron beam path; and said end face pairs being disposed so that the end faces thereof with the same polarity are disposed opposite each other.

2. An X-ray tube as claimed in claim 1 wherein the two arms of each yoke are disposed substantially parallel to each other, at least in a region of said electron beam path.

3. An X-ray tube as claimed in claim 1 wherein each of said two arms of each yoke has a central axis, and wherein said electromagnets are disposed relative to each other so that the respective central axes of the two arms are substantially co-linear.

4. An X-ray tube as claimed in claim 3 wherein said central axes of said two arms, at least in a region of said electron beam path, are disposed in a common plane, said common plane being disposed substantially perpendicularly to said electron beam path.

5. An X-ray tube as claimed in claim 4 wherein said electromagnets are disposed relative to said electron beam path so that a primary direction of propagation of said electron beam intersects a straight line substantially at a center of the straight line, said straight line intersecting said central axes of said arms of said limbs in said region of said electron beam at substantially a right angle at substantially a central location between said end face pairs.

6. An X-ray tube as claimed in claim 1 wherein each of said two arms of each of said yokes has a central axis, and wherein each of said central axes is linear.

7. An X-ray tube as claimed in claim 1 wherein said vacuum housing has a shaft-like housing part disposed between said cathode and said anode through which said electron beam propagates along said electron beam path, and wherein said deflection arrangement is disposed with the respective yokes of said two electromagnets surrounding said shaft-like housing part.

8. An X-ray tube as claimed in claim 7 wherein said shaft-like housing part has an interior diameter which does not significantly exceed a size required for unhindered passage of said electron beam therethrough.

* * * * *